US006257207B1

(12) United States Patent
Inui et al.

(10) Patent No.: US 6,257,207 B1
(45) Date of Patent: Jul. 10, 2001

(54) STARTUP CONTROL APPARATUS OF INTERNAL COMBUSTION ENGINE AND STARTUP CONTROL METHOD

(75) Inventors: Toshio Inui; Katsuhiko Miyamoto; Yoshiyuki Hoshiba, all of Kyoto (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/390,309

(22) Filed: Sep. 3, 1999

(30) Foreign Application Priority Data

Sep. 4, 1998 (JP) ..... 10-250861

(51) Int. Cl.[7] ..... F02D 41/06; F02D 41/02

(52) U.S. Cl. ..... 123/491; 123/480; 123/481; 701/113

(58) Field of Search ..... 123/481, 305, 123/491, 494, 179.16, 179.21, 480; 701/103, 104, 113

(56) References Cited

U.S. PATENT DOCUMENTS 4,512,320 * 4/1985 Abe et al. ..... 123/682
5,746,183 * 5/1998 Parke et al. ..... 123/492
5,809,973 9/1998 Iida et al. .
5,881,694 * 3/1999 Nakada ..... 123/305
5,979,400 * 11/1999 Nishide ..... 123/305
5,979,413 * 11/1999 Ohnuma et al. ..... 123/491

FOREIGN PATENT DOCUMENTS

0984147 A2 * 3/2000 (EP) .

OTHER PUBLICATIONS

Patent Abstracts of Japan—Abstract for JP 10–054272, published Feb. 24, 1998.

* cited by examiner

*Primary Examiner*—Henry C. Yuen
*Assistant Examiner*—Hieu T. Vo

(57) ABSTRACT

A startup control apparatus of an internal combustion engine is provided wherein when an engine starting capability determining device determines that the engine can be successfully started even if driving of part of the fuel injector valves is stopped during engine startup, the fuel injection is stopped with respect to the part of the fuel injector valves. With this arrangement, overshoot of the engine speed that would otherwise occur upon the start of the engine can be suppressed, and unburned fuel components can be prevented from being discharged, thus assuring improved exhaust gas characteristics and improved fuel efficiency.

18 Claims, 5 Drawing Sheets

STARTUP CONTROL APPARATUS OF INTERNAL COMBUSTION ENGINE AND STARTUP CONTROL METHOD

FIELD OF THE INVENTION

The present invention relates to apparatus and method for controlling startup of an internal combustion engine including a plurality of cylinders.

BACKGROUND OF THE INVENTION

In internal combustion engines including a plurality of cylinders and a fuel injector valve for each of the cylinders, for example, a multi-point fuel injection (MPI) engine with a fuel injector valve provided at an intake port of each cylinder, and an in-cylinder injection type internal combustion engine with a fuel injector valve for injecting fuel directly into a combustion chamber of each cylinder, an electronic control unit (ECU) operates to detect the start of cranking of the engine upon receipt of an ON signal from a cranking switch, and then to carry out cylinder identification based on signals received from a crank angle sensor and others. Once the cylinder identification is completed, the ECU drives the fuel injector valve of each cylinder with suitable timing so as to start the engine. In this operation, the ECU sets the driving period or duration of the fuel injector valve so that the amount of fuel ejected from the fuel injector valve during engine startup is larger than that ejected while the engine is idling after warm-up thereof. The amount of fuel ejected from the fuel injector valve during engine startup is relatively large for the reason as follows: where the engine is started in the cold state, and vaporization of the fuel injected into the cylinder is delayed due to a low temperature within the cylinder, for example, a sufficient amount of fuel required for combustion needs to be present around the spark plug so as to fire an air-fuel mixture without fail.

However, if the amount of the fuel is relatively large during startup of the engine as described above, the fuel injection amount per cylinder is increased, thus causing excessive racing of the engine upon combustion, or overshoot of the engine speed. Also, since the total amount of the fuel injected into the internal combustion engine as a whole is increased during startup of the engine, the fuel efficiency may be lowered, and exhaust gas characteristics may deteriorate due to increased unburned fuel components that were not used for combustion and that were eventually dispelled in exhaust gas.

As disclosed in laid-open Japanese Patent Publication No. 10-54272, for example where the water temperature is equal to or lower than a predetermined level after completion of cylinder identification, the fuel injection is halted for a period of time corresponding to two strokes, so that the temperature within the combustion chamber is increased due to a compression effect of the internal combustion engine, and the fuel injector valves are subsequently actuated.

The technique disclosed in the above publication, wherein the fuel injection is stopped for a period of two strokes after cylinder identification is completed, is advantageous in terms of the fuel efficiency and exhaust gas characteristics, as compared with the known technique of increasing the fuel amount. It is, however, difficult to achieve the desired temperature in the combustion chamber by utilizing the compression effect of the internal combustion engine, and the amount of the fuel injected after stopping the fuel injection for a period of two strokes must be determined taking account of the case where the temperature in the combustion chamber was not sufficiently increased, as in the known method of increasing the fuel amount. Also, since the fuel is injected into all of the cylinders in a specific sequence after a halt of the fuel injection, the total amount of fuel injection in the internal combustion chamber as a whole tends to be large during engine startup. Thus, there is a plenty of room for improvements in the above-described known methods, which are to be made for suppressing overshoot of the engine speed, and deterioration of exhaust gas characteristics and fuel efficiency.

SUMMARY OF THE INVENTION

It is therefore an object of the present invention to provide a startup control apparatus of an internal combustion engine which can overcome the above and other shortcomings of conventional apparatuses and that can suppress overshoot of the engine speed, and avoid deterioration of exhaust gas characteristics and fuel efficiency.

To accomplish the above and other objects, the present invention provides a startup control apparatus of an internal combustion engine, which comprises a plurality of cylinders, a plurality of fuel injector valves respectively provided for the plurality of cylinders, and a control unit comprising a fuel injected cylinder limiting device that stops driving of at least one of the fuel injector valves that are timed to inject fuel into the cylinders, during startup of the internal combustion engine.

With the above arrangement, the total amount of the fuel injected into all of the cylinders during startup of the internal combustion engine can be reduced, thereby suppressing overshoot of engine rotation or engine speed, while assuring improved exhaust gas characteristics and fuel efficiency.

In one preferred form of the startup control apparatus as described above, the control unit further comprises an engine starting capability determining device that determines whether the engine can be successfully started even if driving of at least one of the fuel injector valves in fuel injection timing is stopped during startup of the engine, and the control unit permits the fuel injected cylinder limiting device to be activated when the engine starting capability determining device determines that the engine can be successfully started. With this arrangement, the internal combustion engine can be smoothly started with high reliability.

The startup control apparatus as described just above may further include a temperature detecting device that detects a temperature of the engine. In this case, the engine starting capability determining device determines that the engine cannot be successfully started if driving of at least one of the fuel injector valves in fuel injection timing is stopped during startup of the engine, when the temperature detected by the temperature detecting device is lower than a first predetermined temperature. With this arrangement, the fuel injected cylinder limiting device is actuated based on the result of a determination by the engine starting capability determining device, and therefore the internal combustion engine can be smoothly started with high stability and reliability.

In the above case, the temperature detecting device preferably takes the form of a water temperature sensor provided on a main body of the engine and adapted to detect a coolant temperature of the engine, or an ambient temperature sensor that detects an ambient temperature, and the engine starting capability determining device determines whether the engine can be successfully started, based on the outputs of these sensors.

In the startup control apparatus including the temperature detecting device as described above, the control unit may preferably stop operating the fuel injected cylinder limiting device when the temperature detected by the temperature detecting device is higher than a second predetermine temperature that is set to be higher than the first predetermined temperature. Thus, the engine can be started with high stability.

In the above preferred form of the invention, the startup control apparatus may preferably include an engine speed determining device that determines whether the rotating speed of the internal combustion engine reaches a predetermined speed, and the control unit may include a startup control device that causes the fuel injector valves to sequentially inject the fuel into the respective cylinders during engine startup. In this case, the control unit activates the startup control device when the engine speed determining device determines that the rotating speed of the engine does not reach the predetermined speed after the fuel injected cylinder limiting device is activated. Thus, the engine can be started with high stability.

In the above preferred form of the invention, the startup control apparatus may further include a cylinder identifying device that identifies the cylinders, and the control unit may permit the fuel injected cylinder limiting device to be activated after the engine starting capability determining device determines that the engine can be successfully started and the cylinder identifying device completes identification of the cylinders. In this case, the fuel injected cylinder limiting device preferably stops driving of alternate ones of the fuel injector valves in fuel injection timing after the fuel injected cylinder limiting device starts being activated. This arrangement makes it possible to suppress overshoot of engine rotation, and avoid deterioration of exhaust gas characteristics and fuel efficiency, while assuring high engine starting capability.

In another preferred form of the starting control apparatus of the invention, the fuel injector valves are provided on a main body of the internal combustion engine, such that each of the fuel injector valves directly injects the fuel into a corresponding one of the cylinders. In this case, the fuel injection into each cylinder can be accurately controlled, thus surely suppressing overshoot of engine rotation and avoiding deterioration of exhaust gas characteristics and fuel efficiency.

According to another aspect of the present invention, there is provided a startup control method for controlling startup of an internal combustion engine including a plurality of cylinders, and a plurality of fuel injector valves respectively provided for the cylinders, which method comprises the steps of: detecting a start of cranking of the internal combustion engine; identifying the cylinders after the start of cranking of the engine is detected; after cylinder identification is completed, determining, based on temperature information of the engine, whether the engine can be successfully started even if driving of at least one of the fuel injector valves that are timed to inject fuel into cylinders is stopped; and stopping driving of at least one of the fuel injector valves when it is determined that the engine can be successfully started. With this method, the total amount of the fuel injected into all of the cylinders during startup of the internal combustion engine can be reduced, thereby suppressing overshoot of engine rotation or engine speed, while assuring improved exhaust gas characteristics and fuel efficiency.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 4(A) and 4(B) are graphs showing the effects of the startup control apparatus of the internal combustion engine, wherein FIG. 4(A) shows the effect of the startup control apparatus of the present invention, and FIG. 4(B) shows the effects of a conventional startup control apparatus;

FIGS. 5(A) and 5(B) are graphs showing the effects of the startup control apparatus of the internal combustion engine, wherein FIG. 5(A) is a graph useful for comparing the startup control apparatus of the present invention with the conventional startup control apparatus, and FIG. 5(B) is a graph useful for explaining control performed by the startup control apparatus of the present invention when it is found difficult to start the engine.

DETAILED DESCRIPTION OF THE PREFERRED EMBODIMENT

One preferred embodiment of the present invention will be described with reference to the drawings, although modifications to this embodiment will be readily appreciated by those of ordinary skill.

The internal combustion engine of the present embodiment is an in-cylinder injection type engine for a motor vehicle, wherein fuel is injected directly into each engine cylinder to provide an air-fuel mixture that is ignited by a spark plug for combustion thereof.

Figure 2:
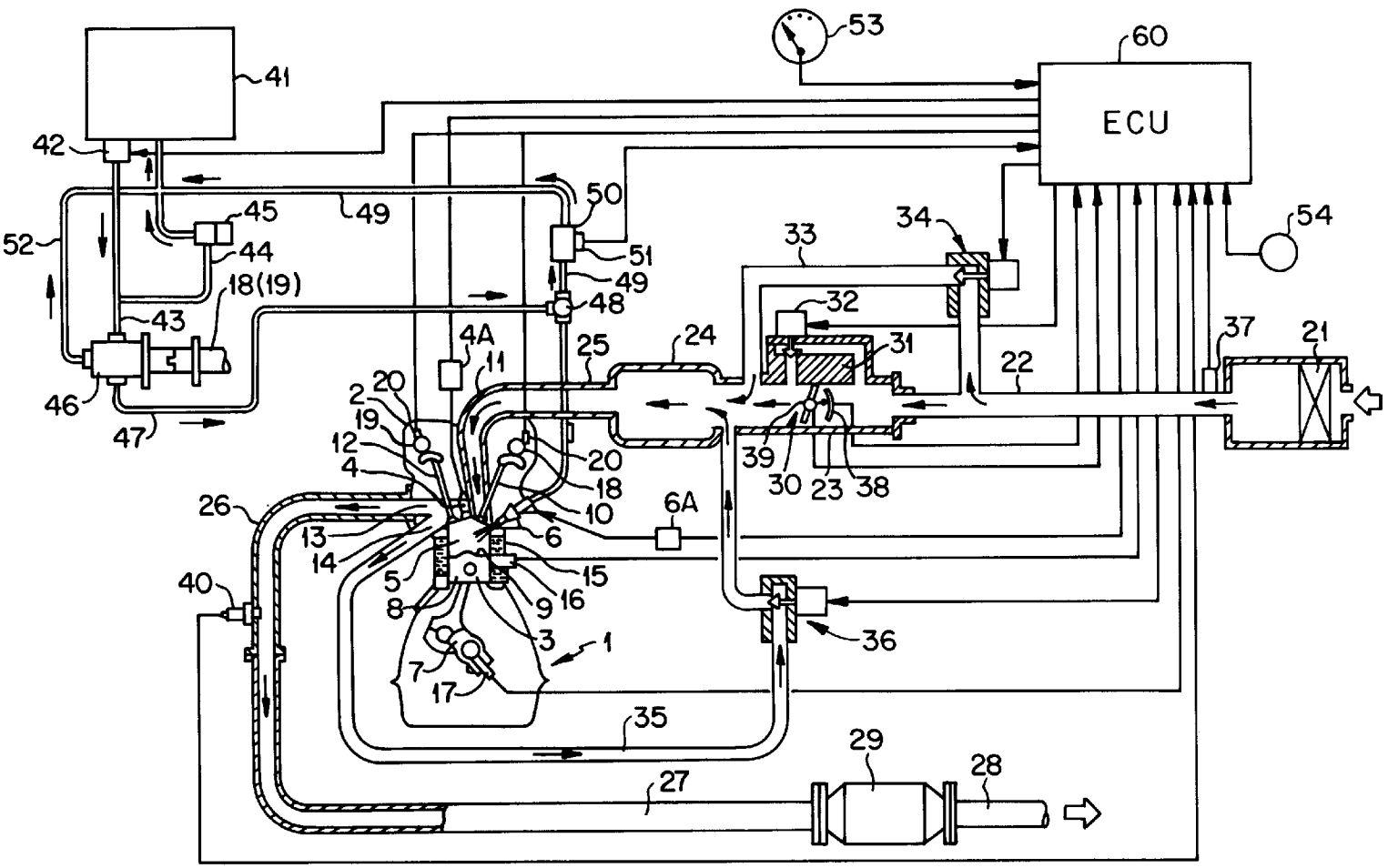
FIG. 2 is a block diagram schematically showing the construction of the internal combustion engine that employs the startup control apparatus of the present invention.

More specifically, as illustrated by FIG. 2, a cylinder head of the engine 1 is provided with a spark plug 3 and a fuel injector valve 6 for each engine cylinder 3, such that the fuel injector valve 6 is directly open or exposed to a combustion chamber 5 defined in the cylinder. The spark plug 3 is driven by a spark plug coil 4A, and the fuel injector valve 6 is driven by a driver 6A. A piston 8 coupled to a crankshaft 7 is mounted in the cylinder 3. A hemispherical cavity or recess 9 is formed in the top face of the piston 8.

The cylinder head 2 includes an intake port 11 that communicates with the combustion chamber 5 via an intake valve 10, and an exhaust port 13 that communicates with the combustion chamber 4 via an exhaust valve 12. The intake port 11 extends upwards from the combustion chamber 5 in a substantially vertical direction, and cooperates with the cavity 9 formed in the top face of the piston 8 to produce a reverse tumble flow of intake air within the combustion chamber 5.

A water jacket 15 disposed on the outer periphery of the cylinder 6 is provided with a water temperature sensor 16 for detecting a coolant temperature that varies with the engine temperature. The water temperature sensor 16 functions as one type of temperature detecting device for detecting the engine temperature in the present embodiment. The crankshaft 7 is equipped with a crank angle sensor 17 that generates a signal at a certain crank angle position, and each of camshafts 18, 19 for driving the intake valve 10 and exhaust valve 12 is equipped with a cylinder identification sensor (cam sensor) 20 that generates a cylinder identification signal indicative of the position of the relevant camshaft. The cylinder identification sensor 20 functions as one type of cylinder identification device in the present embodiment.

The intake system principally consists of an air cleaner 21, intake pipe 22, throttle body 23, surge tank 24, and an intake manifold 25, which are arranged in this order from the upstream side. The intake port 11 is connected to the downstream end portion of the intake manifold 25. The exhaust system principally consists of an exhaust manifold 26 having the exhaust port 12, and exhaust pipes 27, 28, which are arranged in this order from the upstream side, with an exhaust gas purifying catalyst 29 interposed between the exhaust pipe 27 and the exhaust pipe 28.

The throttle body 23 of the intake system includes a throttle valve 30, and a small-diameter first air bypass path (for controlling the idling speed) 31 that bypasses the throttle valve 30. A first air bypass valve 32 is mounted in the first air bypass path 31. In addition, a large-diameter second air bypass path 33 is provided which bypasses the throttle body 23, and a second air bypass valve 34 is mounted in the second air bypass path 33. The idling speed may be controlled by controlling the opening of the first air bypass valve 32, while a large amount of intake air may be introduced into the cylinder 3 by controlling the opening of the second air bypass valve 34.

A large-diameter exhaust gas recirculation port (EGR port) 14 diverges from the exhaust port 13, to be connected to a part of the throttle body 23 (right under the surge tank 24) through an EGR pipe 35. An EGR valve 36 of a stepper motor type, for example, is provided in the middle of the EGR pipe 36, for controlling the exhaust gas recirculation amount (EGR amount).

An air flow sensor 37 for detecting the amount of intake air is located right downstream of the air cleaner 21, and a throttle position sensor 38 for detecting the throttle opening is provided in the vicinity of the throttle valve 30. In the throttle body 23 is also provided an idle switch 39 that detects the full closed state of the throttle valve 30 to generate an idle signal. Also, an $O_2$ sensor 40 is provided in the exhaust manifold 26 for detecting whether the air/fuel ratio is on the rich or lean side relative to the stoichiometric ratio.

A fuel supply system for the engine 1 will be now described in detail. Initially, fuel in a fuel tank 41 is pressurized by a low pressure fuel pump 42 of the motor-driven type, and then fed to a high pressure fuel pump 46 through a low pressure feed pipe 43. Here, the high pressure fuel pump 46 is driven by the engine 1 in association with rotation of the camshaft 18. The high pressure fuel discharged from the high pressure fuel pump 46 is delivered from the high-pressure feed pipe 47 into each fuel injector valve 6 through a delivery pipe 48.

A low pressure regulator 45 is connected to the low pressure feed pipe 43 via a return pipe 44, and serves to control the pressure of the fuel in the low pressure feed pipe 43 to a predetermined low pressure level (for example, about 0.3 to 0.4 MPa). Also, a high pressure regulator 50 is connected to the delivery pipe 48 via a return pipe 49, and serves to control the pressure of the fuel in the delivery pipe 48 to a predetermined high pressure level (for example, about 2 to 7 MPa).

In addition, a fuel pressure selector valve 51 is provided in the high-pressure regulator 40. When the selector valve 51 is placed in its open position, the fuel in the return pipe 49 is released, thereby to control the fuel pressure of the delivery pipe 48 to a desired low level. A return pipe 52 is also provided which returns redundant fuel in the high pressure fuel pump 46 back to the fuel tank 41.

An electronic control unit (ECU) 60 is provided for controlling the operations of respective engine control elements, including the spark plug 4, fuel injector valve 6, first air bypass vale 32, second air bypass valve 34, EGR valve 36, low pressure fuel pump 42, and the fuel pressure selector valve 51. The ECU 60 includes an input/output device, storage device for storing control programs, control maps and others, central processing unit (CPU), timer, counter, and so forth, and controls the above-indicated engine control elements, based on detected information from various sensors as described above, position information from a key switch 53, ambient temperature information detected by an ambient temperature sensor 54, and so on. Since the ambient temperature detected by the ambient temperature sensor 54 has an influence on the engine temperature, this sensor 54 serves as one type of temperature detection device for detecting the engine temperature in the present embodiment.

The engine of the present embodiment, in particular, is an in-cylinder injection type engine, in which the fuel injection into the combustion chamber 5 can be carrier out in free timing, i.e., at any point in each combustion cycle. Thus, the fuel is mainly injected during a suction stroked so as to permit premixed combustion, or mainly injected during a compression stroke so as to permit stratified charge combustion utilizing the reverse tumble flow as described above. To achieve the premixed combustion, the engine operates in a selected one of several combustion modes, including a stoichiometric operation mode in which the air-fuel ratio is held in the vicinity of the stoichiometric ratio through feedback control based on information detected by the $O_2$ sensor 40, an enrichment operation mode in which the air-fuel ratio is controlled to be richer than the stoichiometric ratio, and a normal lean operation mode in which the fuel injection occurs during a suction stroke so as to control the air-fuel ratio to be leaner than the stoichiometric ratio. To achieve the stratified combustion, the engine operates in an extremely lean operation mode in which the fuel injection occurs during a compression stroke so as to control the air-fuel ratio to be much leaner than the stoichiometric ratio.

The ECU 60 selects one of the engine operation modes according to a predetermined map, based on the engine speed Ne and the average effective pressure Pe representing the engine load condition. Generally, the ECU 60 selects the extremely lean operation mode when the engine speed Ne and the average effective pressure Pe are small, and selects the normal lean operation mode, stoichiometric operation mode, and the enrichment operation mode in this order as the engine speed Ne and the average effective pressure Pe increase.

The ECU 60 selects the stoichiometric operation mode when the required engine load is large, and selects the enrichment operation mode when the required engine load is even larger. The ECU 60 selects the normal lean operation mode when the required engine load is small, and selects the extreme lean operation mode when the required engine load is even smaller.

The engine speed Ne is calculated based on information detected by the crank angle sensor 17, and the average effective pressure Pe is calculated based on the engine speed Ne and the throttle opening (corresponding to the degree of depression of an accelerator pedal) that is detected by the throttle position sensor 38.

Based on the engine speed N3 and the average effective pressure Pe thus calculated, the ECU 60 sets a target air-fuel ratio, fuel injection timing, ignition timing, EGR amount and others, according to a map established for each of the operating modes. Also, the ECU 60 sets the amount of fuel to be injected, based on the target air-fuel ratio and the amount of intake air detected by the air flow sensor 37, and controls the fuel injector valve 6, ignition plug 4, EGR valve 36 and so forth.

Figure 1:
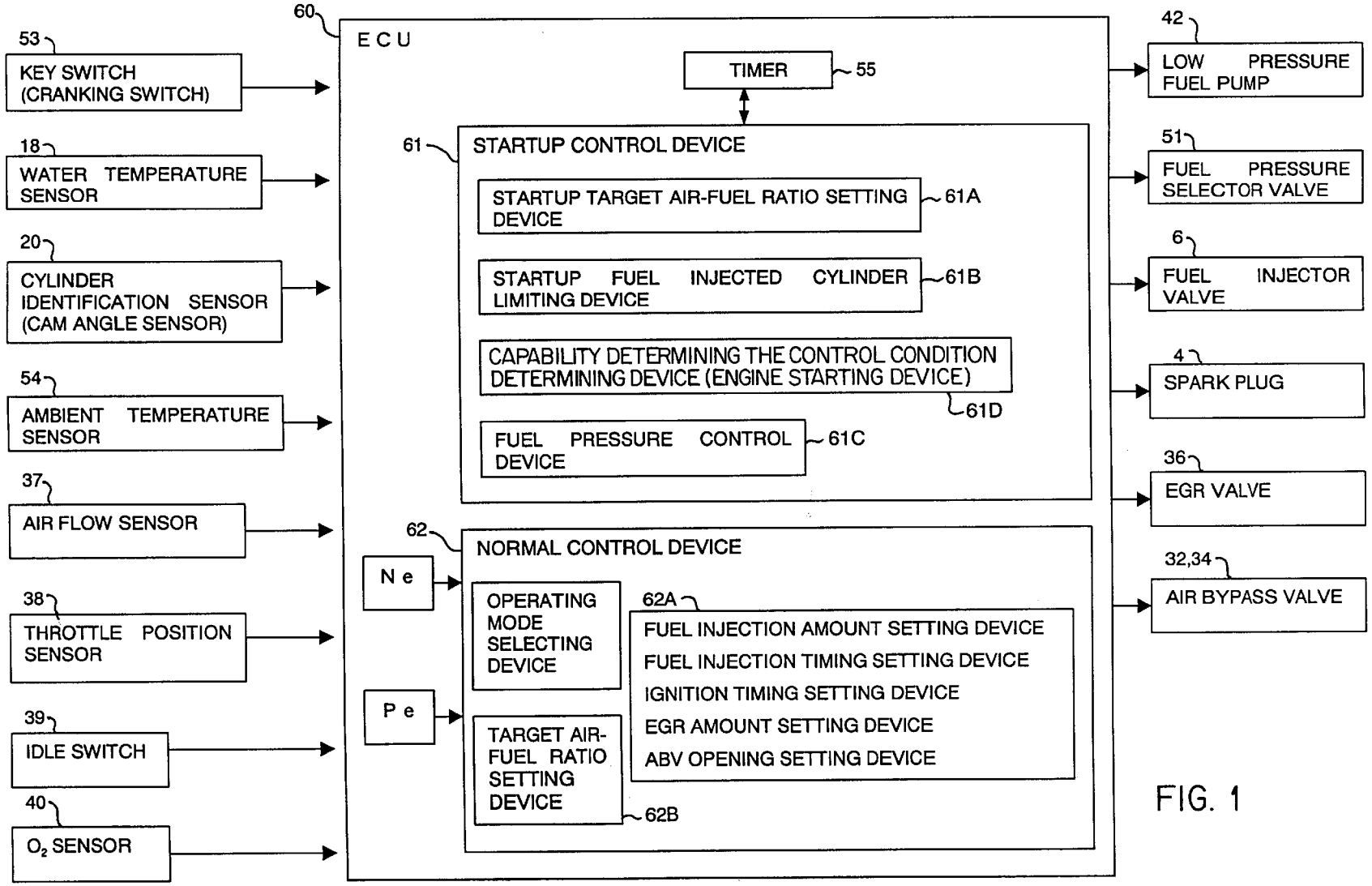
FIG. 1 is a block diagram schematically showing the construction of a startup control apparatus of an internal combustion engine according to one embodiment of the present invention.

As shown in FIG. 1, the ECU 60 has a startup control device of the internal combustion engine 61 for performing engine control during engine startup, and a normal control device 62 for performing engine control during normal running of the vehicle.

The normal control device 62 includes an engine operation mode selecting device 62A for selecting one of the above-indicated engine operation modes based on the calculated engine speed Ne and average effective pressure Pe, and a target air-fuel ratio setting device 62B for setting the target air-fuel ratio for each engine operation mode based on the engine speed Ne and average effective pressure Pe. The normal control device 62 further includes devices for setting the fuel injection amount (open-valve duration of the fuel injector valve), the fuel injection timing (point of time at which the fuel injector valve is opened), spark ignition timing, the EGR amount (degree of opening of the EGR valve), and the openings of the air bypass valves (ABV) 32, 34, respectively. Namely, the normal control device 62 includes a fuel injection amount setting device, fuel injection timing setting device, spark ignition timing setting device, EGR amount setting device, and the ABV opening setting devices. Based on the outputs of these devices, the ECU 60 is adapted to control the fuel injector valve 6, spark plug 4, EGR valve 36, air bypass valves 32, 34, and other components.

The startup control devices 61, on the other hand, performs control from a point of time when the vehicle is started, i.e., when the key switch 53 (or cranking switch) is placed in the ON state, to a point of time when complete combustion takes place in the combustion chamber of each cylinder. The judgment as to whether complete combustion takes place in the combustion chamber is made by determining whether the engine speed Ne has reached a predetermined speed Ne1 or not.

More specifically, a starter motor starts rotating the engine when the cracking switch 53 is turned ON, but the rotating speed of the engine is extremely low when the engine is only rotated by the starter motor. Once completion combustion takes place in the combustion chamber, however, the engine speed Ne is increased due to the combustion energy, to exceed the predetermined speed (startup completion speed) Ne1. Thus, the engine is judged as being in the complete combustion state when the engine speed Ne exceeds the predetermined speed Ne1.

The startup control is performed only for an extremely short time (about several seconds). If appropriate control is not performed during engine startup, however, overshoot of engine rotation may occur immediately after the startup period, or a large amount of unburned fuel components, such as hydrocarbon (HC), is discharged from the combustion chamber, resulting in deterioration of exhaust gas characteristics and reduced fuel efficiency. In the present embodiment, therefore, the startup control device 61 is designed to implement startup control operations so as to overcome these problems.

As shown in FIG. 1, the startup control device 61 includes a starting target air-fuel ratio setting device 61A for setting a target air-fuel ratio during engine startup based on the engine coolant temperature detected by the water temperature sensor 18, a fuel injected cylinder limiting device 61B for injecting the fuel into a limited number of cylinders selected from a plurality of cylinders (four cylinders in the present embodiment) originally installed on the vehicle, under certain conditions during engine startup, and a fuel pressure control device 61C for controlling the low pressure fuel pump 42 and the fuel pressure selector valve 51.

The starting target air-fuel ratio setting device 61A sets a target air-fuel ratio during engine startup, to be richer than the stoichiometric air-fuel ratio, thereby ensuring that the spark plug 4 fires or ignites an air-fuel mixture without fail. The starting target air-fuel ratio is determined based on the coolant temperature. Namely, the starting target air-fuel ratio is set to be richer as the coolant temperature is lower. This is because the fuel is less likely to be evaporated upon start of the engine due to a low temperature in the combustion chamber, and the startup time is prolonged and the spark plug smolders if the fuel injection amount is equivalent to that of the engine that has been warmed up, which tends to cause a failure of the spark plug to fire the fuel-air mixture. Accordingly, the fuel injection amount is increased as the temperature of the combustion chamber (or the coolant temperature) is lower, so that an increased amount of fuel is evaporated so as to enable the spark plug to fire or ignite the fuel-air mixture.

The fuel injected cylinder limiting device 61B restricts or inhibits the operations of selected fuel injector valves 6 under certain conditions during engine startup. For example, if certain conditions are satisfied after cylinder identification is completed based on detection signals of the cylinder identification sensors (cam angle sensors) 20, the cylinder limiting device 61B only permits fuel injection into alternate ones of the cylinders.

More specifically described, in the case of the four-cylinder engine as in the present embodiment, the fuel is injected from the fuel injector valves 6 into the first, third, fourth and second cylinders in this order during normal running of the vehicle after the startup period. During the startup period, on the other hand, if the first cylinder is determined as a cylinder into which the fuel can be timely injected upon completion of cylinder identification, the fuel is initially injected into the first cylinder, and the fuel injection into the third cylinder is stopped. The fuel is then injected into the fourth cylinder in the same manner with the first cylinder, and the fuel injection into the second cylinder is stopped in the same manner with the third cylinder.

When the fuel can be timely injected into the third cylinder immediately after completion of cylinder identification, the fuel is initially injected into the third cylinder, followed by inhibition of fuel injection into the fourth cylinder, and then injected into the second cylinder, followed by inhibition of fuel injection into the first cylinder.

The number of cylinders into which the fuel is injected is limited during engine startup by the fuel injected cylinder limiting device 61B, under the following conditions: (1) the engine coolant temperature WT detected by the water temperature sensor 18 is within a certain range ($WT1 \leqq WT \leqq WT2$), (2) the ambient temperature AT detected by the ambient temperature sensor 54 is within a certain range ($AT1 \leqq AT$), (3) the engine speed Ne calculated based on the detected information of the crank angle sensor 17 is equal to or lower than the predetermined speed Ne1

(that indicates the finish of the startup period, (4) the time elapsed after the commencement of cranking is within a certain period of time (the timer value T of the timer 55 that starts measuring upon the commencement of cranking is equal to or smaller than T1, or T≦T1). The startup control device 61 includes a control condition judging device (or starting capability judging device) 61D that determines whether these conditions (1) to (4) are satisfied or not. If the control condition judging device 61D determines that all of these conditions (1) to (4) (among which the conditions (1) and (2) relate to the engine temperature) are satisfied, the number of cylinders into which the fuel is injected is limited by the starting fuel injected cylinder limiting device 61B.

The above control for limiting the number of cylinders into which the fuel is injected during engine startup needs to be performed so as to suppress overshoot of the engine speed and deterioration of exhaust gas characteristics immediately after the startup period, and also ensure that the engine is started without fail during the startup period.

As one of the control conditions (for determining the engine starting capability when the number of fuel injected cylinders is limited), the lower limit value WT1 is established for the engine coolant temperature WT that is generally considered to be proportional to the engine temperature. If the coolant temperature WT is equal to or higher than the lower limit value WT1, the control for limiting the number of cylinders subjected to fuel injection may be performed, namely, the fuel may be injected into selected cylinders. If the coolant temperature WT1 falls below the lower limit value WT1, the control for limiting the number of fuel injected cylinders may deteriorate the engine starting capability, and therefore the fuel is injected into all of the existing cylinders in a certain sequence under normal startup control, without performing the control for limiting the number of fuel injected cylinders.

Where the ambient temperature AT is extremely low, the engine starting capability may deteriorate under the control of limiting the number of fuel injected cylinders, even if the coolant temperature WT is not lowered below the lower limit value WT1. As another engine starting capability condition, the lower limit value AT1 is established for the ambient temperature AT, and if the ambient temperature AT falls below the lower limit value AT1, the fuel is injected into all of the cylinders in a certain sequence under normal startup control.

Where the engine coolant temperature WT is sufficiently high (in general, when the engine is re-started before being cooled down), the starting target air-fuel ratio setting device 61A does not set the starting target air-fuel ratio to be far richer than the stoichiometric ratio, thus eliminating the need to particularly suppress overshoot of the engine speed or avoid deterioration of exhaust gas characteristics upon completion of the startup control operation. As another control condition, therefore, the upper limit value WT2 of the coolant temperature WT is established, and, if the coolant temperature WT exceeds the upper limit value WT2, the fuel is injected into all of the cylinders in a certain sequence under normal startup control.

The above-described condition (3) is used for determining whether the engine has been started or not. Namely, if the engine speed Ne exceeds the predetermined speed Ne1 (that indicates the finish of the engine startup period), the fuel control for enriching the air-fuel ratio during engine startup is terminated. At this point of time, the engine does not suffer any longer from overshoot of the engine speed and deterioration of exhaust gas characteristics, and therefore the above control for limiting the number of fuel injected cylinders is terminated, and replaced by a normal control operation in which the fuel is injected into all of the cylinder in a certain sequence.

Where the condition (4) is satisfied, namely, where the engine speed Ne does not exceed the predetermined speed (that indicates the finish of the engine startup) even after a certain period of time elapses (timer value T>T1), it is found difficult to start the engine under the control for limiting the number of fuel injected cylinders. In this case, the control for limiting the number of fuel injected cylinders is terminated, and the normal startup control is performed under which the fuel is injected into all of the existing cylinders in a certain sequence, to ensure that the engine can be started without fail.

When the key switch 53 is placed on the ON state (namely, the cranking switch is turned on), the fuel pressure control device 61C actuates the lower pressure fuel pump 42, and places the fuel pressure selector valve 51 in the open state so as to release the fuel. Upon a lapse of a predetermined time after the commencement of cranking, the fuel pressure control device 61C places the fuel pressure selector valve 51 in the closed state, and subsequently increases the fuel pressure by means of the high pressure fuel pump 46. Thus, vapor is discharged from the delivery pipe 48 by opening the fuel pressure selector valve 51 upon start of the engine.

Figure 3:
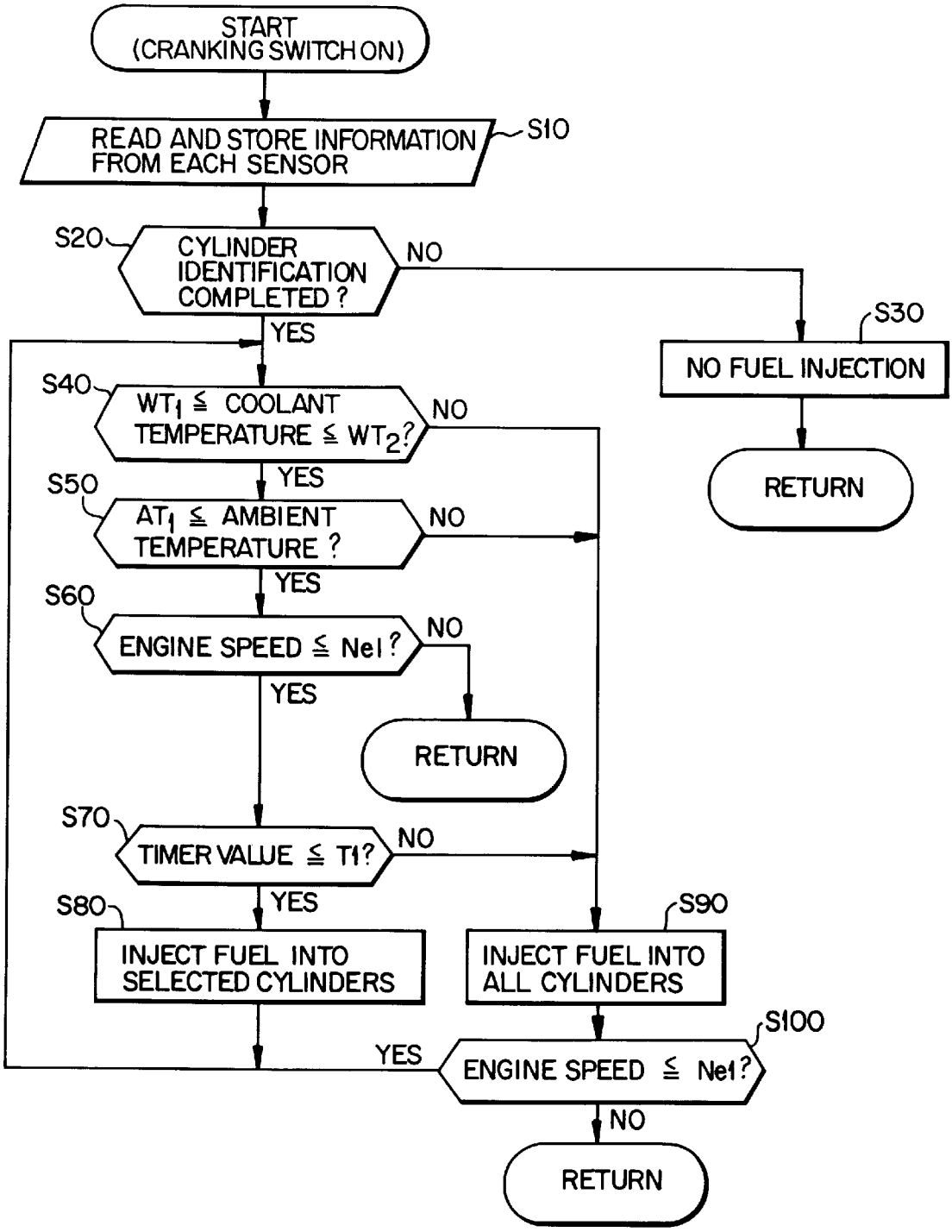
FIG. 3 is a flowchart showing a control routine to be executed by the startup control apparatus of the internal combustion engine according to the present invention.

The startup control device of the internal combustion engine, as one embodiment of the present invention, is constructed as described above and is thus adapted to execute a startup control routine as shown in the flowchart of FIG. 3 by way of example.

The control routine is initiated when the key switch 53 (or cranking switch) is turned on, and step S10 is executed to store current engine operating states received from various sensors. Step S20 is then executed to determine whether cylinder identification has been carried out, based on information from the cylinder identification sensors 20. If the cylinder identification has not been completed, no fuel injection is conducted in step S30. If the cylinder identification has been completed, judgments on the control conditions of S40 to S70 are made as follows.

In step S40, it is determined whether the engine coolant temperature WT detected by the water temperature sensor 17 is within a predetermined range (WT1≦WT≦WT2). If the coolant temperature WT is lower than the lower limit value WT1 (the first predetermined temperature), the engine temperature may be excessively low, and the engine starting capability may deteriorate if the fuel is selectively injected into only a limited number of cylinders. In this case, therefore, the control flow goes to step S90 to inject the fuel into all of the cylinders in a certain sequence.

Upon start of the engine, the enrichment operation mode is selected so as to ensure that a spark is produced by the spark plug to fire an air-fuel mixture within the combustion chamber. In this mode, the starting target air-fuel ratio is set to be rich, and the amount of the fuel to be injected is increased.

If the coolant temperature WT exceeds the upper limit value WT2 (the second predetermined temperature), which means that the engine coolant temperature is sufficiently high, the starting target air-fuel ratio is not set to be so rich, thus hardly causing overshoot of the engine speed and deterioration of exhaust gas characteristics immediately after the startup period. When the coolant temperature WT exceeds the upper limit value WT2, too, the control flow goes to step S90 to sequentially inject the fuel into all of the cylinders.

Next, step S50 is executed to determine whether the ambient temperature AT detected by the ambient temperature sensor 54 is within a predetermined range (AT1≦AT), namely, whether the above-described condition (2) is satisfied. If the ambient temperature AT is excessively low (i.e., if the ambient temperature AT is equal to or lower than the lower limit value AT1), the engine starting capability may be deteriorated by limiting the number of cylinders to which the fuel is injected, even if the coolant temperature WT does not fall below the lower limit value WT1. If an affirmative decision (YES) is obtained in step S50, therefore, the control flow goes to step S90 to inject the fuel into all of the cylinders in a certain sequence.

Next, step S60 is executed to determine whether the engine speed Ne calculated based on the detected information of the crank angle sensor 17 is equal to or lower than a predetermined speed Ne1 (that indicates the finish of the startup period), namely, the above-described condition (3) (Ne≦Ne1) is satisfied or not. (This step corresponds to the engine speed determining device.) If step S60 determines that the engine speed Ne exceeds the predetermined speed Ne1 (that indicates the finish of the startup period), the fuel control (enrichment of the air-fuel ratio) performed during the engine startup is finished, and the control for limiting the number of fuel injected cylinders is also finished.

In step S70, it is determined whether the time elapsed after the commencement of cranking is within a predetermined period of time (the counter value T of the timer 55 that starts measuring upon the start of cranking is equal to or smaller than T1, or T T1). If the counter value T is larger than T1, namely, if the engine speed Ne does not exceed the predetermined speed Ne1 (that indicates the finish of the startup period) even after the predetermined period of time T1 elapses, the engine starting capability may deteriorate, and therefore the control for limiting the number of fuel injected cylinders is stopped so as to assure a sufficiently high engine starting capability. The control flow then goes to step S90 to inject the fuel into all of the cylinders.

By contrast, if affirmative decisions (YES) are obtained in all of step S40 to S70, namely, all of the control conditions of these steps are satisfied, the control flow goes to step S80 to perform a control operation for limiting the number of cylinders into which the fuel is injected. This control operation may be performed, for example, by 1) initially injecting the fuel into the first cylinder, if it is determined as the one into which the fuel can be timely injected upon completion of cylinder identification, 2) stopping the fuel injection into the next third cylinder, 3) injecting the fuel into the fourth cylinder in the same manner as with the first cylinder, and 4) stopping the fuel injection into the second cylinder in the same manner as with the third cylinder. Namely, the fuel injection from the fuel injector valve 6 is inhibited with respect to alternate ones of the cylinders. It is also to be noted that the air-fuel ratio of each cylinder subjected to fuel injection is controlled to be rich under the fuel control generally performed during the engine startup.

After step S90 is executed, the control flow goes to step S100 to determine whether the engine speed Ne is equal to or lower than the predetermined speed Ne1 (that indicates the finish of the startup period). If the engine speed Ne exceeds the predetermined speed Ne1, the fuel control during engine startup (enrichment of the air-fuel ratio) is terminated, and the control for limiting the number of fuel injected cylinders is also terminated.

The air-fuel mixture supplied to the selected cylinders for which the fuel injector valves are actuated under the above control for limiting the number of fuel injected cylinders has an increased fuel concentration, as in the case where the fuel is sequentially injected into all of the cylinders, thus enabling the spark plug 4 to rapidly fire the mixture without fail, without incurring deterioration of the engine starting capability. Since the fuel injection is carried out with respect to only the selected ones of the cylinders, the engine as a whole does not suffer from overshoot of engine rotation, while assuring improved exhaust gas characteristics and fuel efficiency.

Figure 4A:
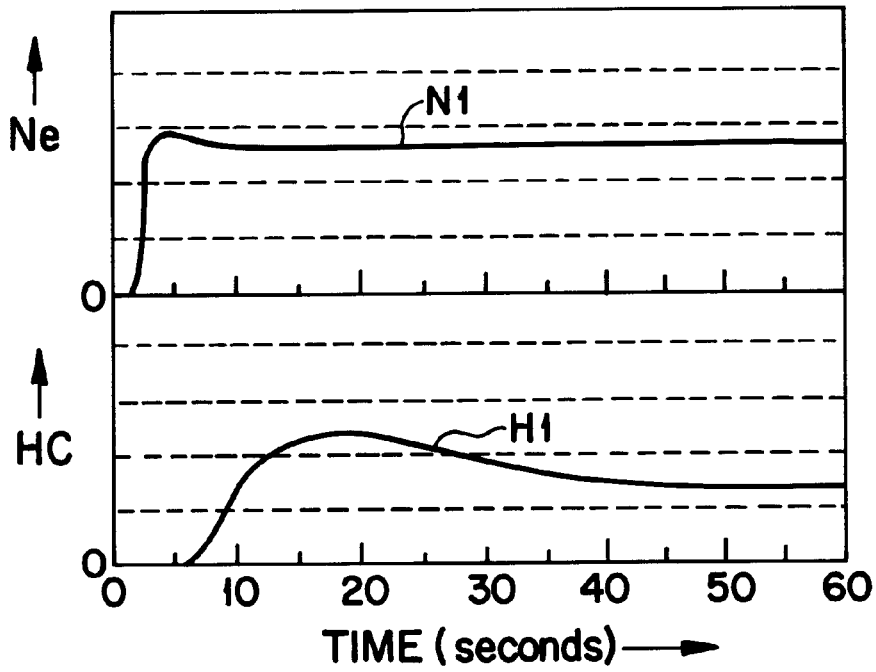
FIG. 4A (CONVENTIONAL ART)
Figure 4B:
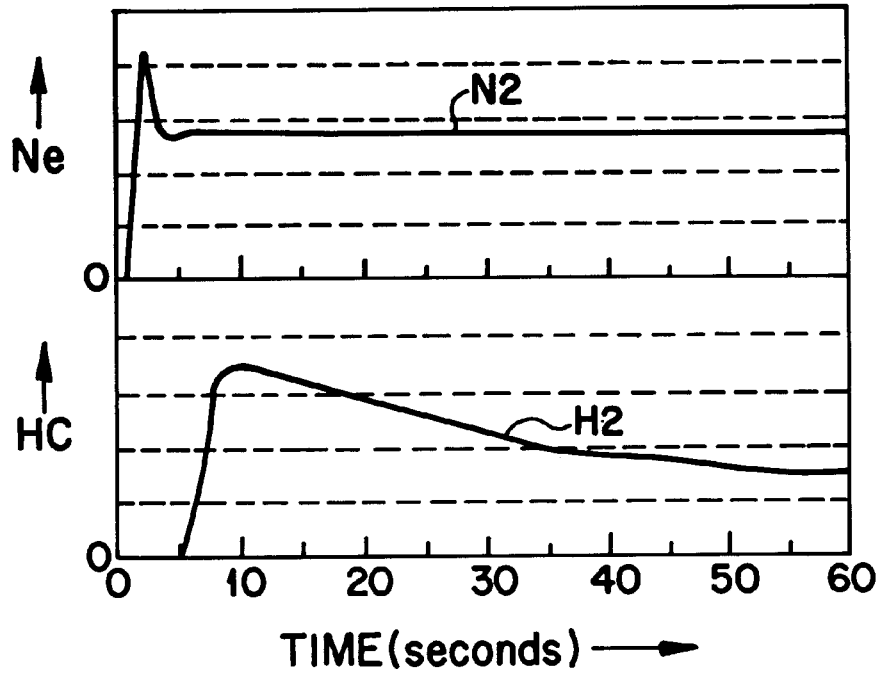
FIG. 4B (CONVENTIONAL ART)

FIG. 4(A) and FIG. 4(B) are graphs each showing changes in the engine speed (Ne) and the amount of hydrocarbon (HC) discharged during engine startup, in relation to the time measured from the commencement of cranking. FIG. 4(A) shows the case where the startup control apparatus of the present embodiment was used, namely, where the starting target air-fuel ratio was set to be rich, and the fuel is injected into only selected cylinders, and FIG. 4(B) shows a conventional case where the starting target air-fuel ratio is set to be rich, and the fuel is injected into all of the cylinders. It will be understood from FIGS. 4(A) and 4(B) that the use of the startup control apparatus of the present embodiment leads to reduced overshoot of the engine speed and a more stable engine starting action, as indicated by curve N1 compared to curve N2 showing the conventional case. By comparing the amount of hydrocarbon (HC) discharged during engine startup as indicated by curve H1 in FIG. 4(A) with that indicated by curve H2 in FIG. 4(B), it will be understood that the HC amount (H1) discharged from the engine of the present embodiment is significantly reduced with respect to that (H2) from the conventional engine. In this connection, the scaling of the vertical and horizontal axes of FIG. 4(A) is identical with that of FIG. 4(B).

Figure 5A:
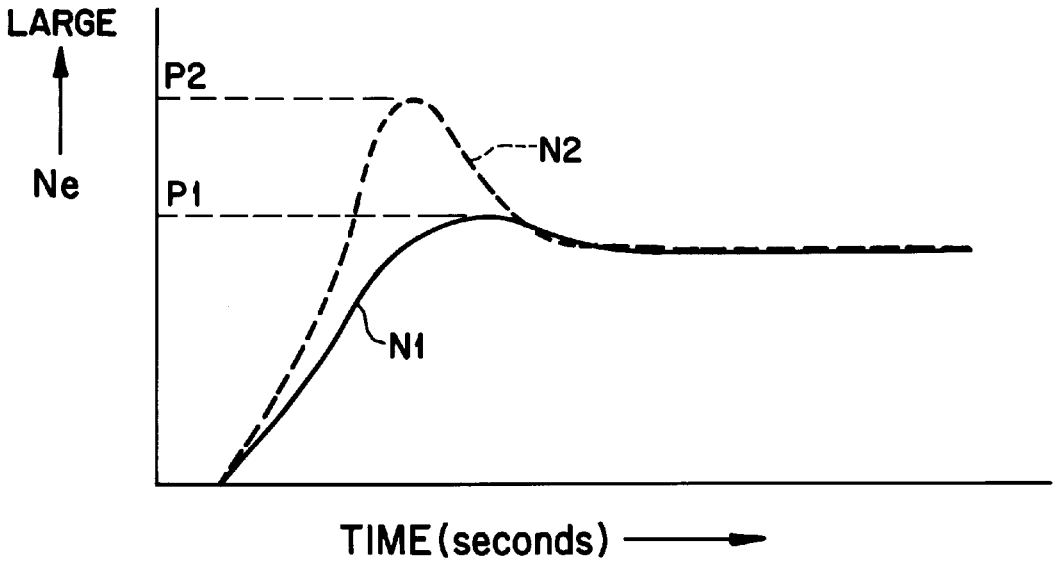

The graph of FIG. 5(A) shows a part of the graphs of FIGS. 4(A) and 4(B) in enlargement, indicating the relationship between the engine speed (vertical axis) and the time (horizontal axis), wherein P1 denotes a peak value of the engine speed (curve N1) during engine startup when the present startup control apparatus was used, and P2 denotes a peak value of the engine speed (curve N2) during engine startup when the conventional startup control apparatus was used. It will be understood from FIG. 5(A) that the use of the startup control apparatus of the present embodiment leads to a significant reduction in the overshoot of the engine speed during engine startup, as indicated by curve N1, compared to the case (curve N2) where the conventional control device is used.

Figure 5B:
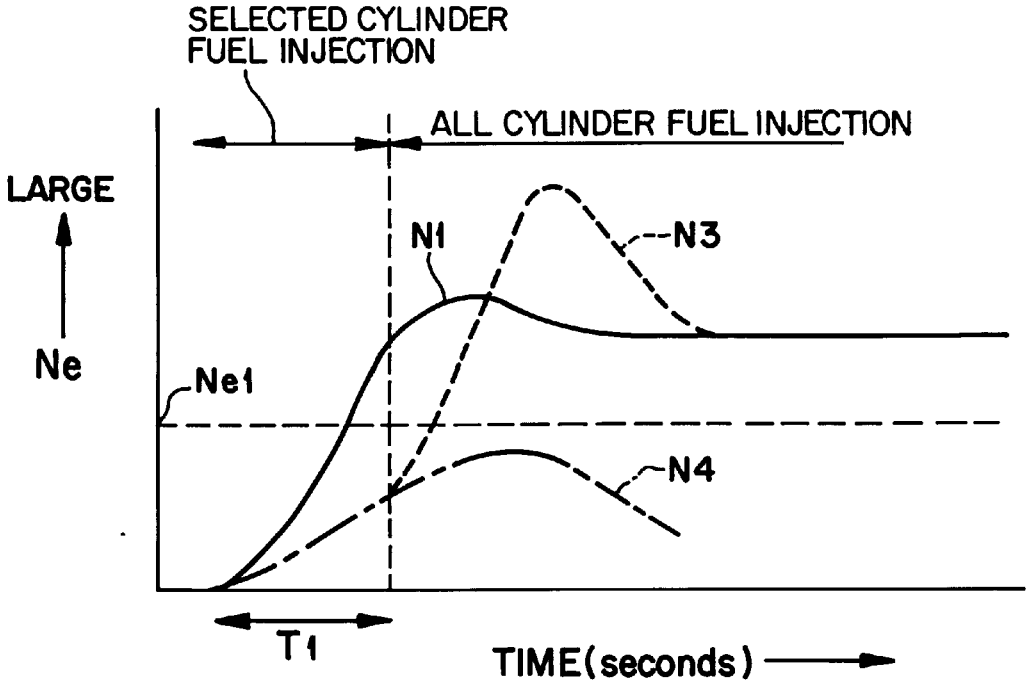

When a negative decision (No) is obtained in step S70 of FIG. 3, and the control flow goes to step S90, the engine speed Ne changes with time as shown in FIG. 5(B). More specifically, where the fuel is injected into only selected ones of the cylinders, the engine speed Ne normally increases to exceed the predetermined speed Ne1 (that indicates the finish of the startup period), by the time when a predetermined time T1 elapses after the cranking switch is turned on, as indicated by curve N1. However, if the engine speed Ne does not reach the predetermined speed Ne1 even upon a lapse of the predetermined time T1 after the start of cracking, the control device judges that the engine starting capability deteriorates because the fuel is injected into only the selected ones of the cylinders, and the fuel injection mode is switched to the one in which the fuel is injected into all of the cylinders in a certain sequence, so as to complete the engine starting action without fail. In this case, the engine speed changes with time as indicated by curve N3.

It is to be understood that the present invention is not limited to the illustrated embodiment, but may be otherwise embodied with various changes or modifications, without departing from the principle of the present invention.

In the illustrated embodiment, the fuel is initially injected into one of the cylinders that is ready to receive the fuel upon completion of cylinder identification, and the fuel injection into subsequent alternate cylinders is stopped. It is, however, possible to initially inject the fuel into a predetermined or fixed one of the cylinders upon completion of cylinder identification. It is also possible to stop the fuel injection into one of the cylinders that is ready to receive the fuel upon completion of cylinder identification, and then stop the fuel injection with respect to subsequent alternate ones of the cylinders.

While the fuel injection into alternate cylinders is stopped in the illustrated embodiment, it is possible to stop the fuel injection with respect to every two or more cylinders.

Furthermore, the startup control apparatus of the present invention may be used in any type of engine, such as a series engine, a V-type engine, and a horizontal opposed engine, including any number of cylinders that is more than one.

While the present invention is effectively applied to an in-cylinder or direct injection type engine that is surely able to control the fuel injection into each cylinder as in the illustrated embodiment, the invention is equally applicable to, for example, a multi-point fuel injection (MPI) type engine in which fuel injector valves are provided at intake ports, or other type of engine, provided that the fuel injection can be effected with respect to each cylinder.

The present invention may also applied to internal combustion engines for use in hybrid electric automobiles of series type or parallel type, and internal combustion engines used for driving general vehicles.

In particular, the internal combustion engine of a hybrid electric automobile is started and stopped in a repetitive manner, according to changes in the battery capacity, and the frequency of starting and stopping the engine is higher than that of ordinary internal combustion engines. Thus, the present invention is most effectively applied to such vehicles that repeat start and stop of the engine.

What is claimed is:

1. A startup control apparatus of an internal combustion engine, comprising:

a plurality of cylinders;

a plurality of fuel injector valves provided for the plurality of cylinders, respectively;

a control unit comprising a fuel injected cylinder limiting device that controls at least one of the fuel injector valves to limit an amount of fuel injected into the corresponding cylinders during startup of the internal combustion engine; and an engine starting capability determining device capable of identifying a number of fuel injector valves of less than all of the fuels injector valves that are necessary for starting the engine, the engine being started using only the fuel injector valves identified by the engine starting capability determining device.

2. A startup control apparatus according to claim 1, wherein the fuel injected cylinder limiting device stops at least one of the fuel injector valves during startup of the internal combustion engine.

3. A startup control apparatus according to claim 1, wherein said control unit further comprises an engine starting capability determining device that determines whether the engine can be successfully started by controlling the at least one of the fuel injector valves to limit the amount of fuel injected during startup of the engine, and wherein said control unit permits said fuel injected cylinder limiting device to be activated when the engine starting capability determining device determines that the engine can be successfully started.

4. A startup control apparatus according to claim 3, further comprising:

a temperature detecting device that detects a temperature of the engine; and wherein the engine starting capability determining device determines that the engine cannot be successfully started if driving of the at least one fuel injector valves is stopped during startup of the engine when the temperature detected by the temperature detecting device is lower than a first predetermined temperature.

5. A startup control apparatus according to claim 4, wherein the temperature detecting device comprises:

a water temperature sensor provided on a main body of the engine and adapted to detect a coolant temperature of the engine, and wherein the engine starting capability determining device determines whether the engine can be successfully started based on the coolant temperature detected by the water temperature sensor.

6. A startup control apparatus according to claim 4, wherein the temperature detecting device comprises:

an ambient temperature sensor that detects an ambient temperature, and wherein the engine starting capability determining device determines whether the engine can be successfully started based on the ambient temperature detected by the ambient temperature sensor.

7. A startup control apparatus according to claim 4, wherein the control unit stops operating the fuel injected cylinder limiting device when the temperature detected by the temperature detecting device is higher than a second predetermined temperature that is set to be higher than the first predetermined temperature.

8. A startup control apparatus according to claim 3, further comprising:

an engine speed determining device that determines whether a rotating speed of the internal combustion engine reaches a predetermined speed;

wherein the control unit comprises a startup control device that causes the fuel injector valves to sequentially inject the fuel into the respective cylinders during engine startup; and wherein the control unit activates the startup control device when the engine speed determining device determines that the rotating speed of the engine does not reach the predetermined speed within a predetermined period after the fuel injected cylinder limiting device is activated.

9. A startup control apparatus of an internal combustion engine according to claim 3, further comprising:

a cylinder identifying device that identifies the cylinders;

wherein the control unit permits the fuel injected cylinder limiting device to be activated after the engine starting capability determining device determines that the engine can be successfully started and the cylinder identifying device completes identification of the cylinders.

10. A startup control apparatus according to claim 9, wherein said fuel injected cylinder limiting device stops driving of alternate ones of the fuel injector valves after the fuel injected cylinder limiting device is activated.

11. A startup control apparatus according to claim 1, wherein said fuel injector valves are provided on a main body of the internal combustion engine, such that each of the fuel injector valves directly injects the fuel into a corresponding one of the cylinders.

12. A startup control method for controlling startup of an internal combustion engine including a plurality of cylinders, and a plurality of fuel injector valves respectively provided for the cylinders comprising:

detecting a start of cranking of the internal combustion engine;

identifying the cylinders after the start of cranking of the engine is detected;

after cylinder identification is completed, determining whether the engine can be successfully started by driving less than all of the fuel injector valves that are timed to inject fuel into cylinders, based on temperature information of the engine; and controlling driving of the fuel injector valves to limit fuel injection based on whether it is determined that the engine can be successfully started by driving less than all of the fuel injector valves.

13. A startup control method according to claim 12, wherein the controlling includes stopping the driving of at least one of the fuel injector valves when it is determined that the engine can be successfully started by driving less than all of the fuel injector valves.

14. A startup control method according to claim 13, further comprising:

determining whether a rotating speed of the internal combustion engine reaches a predetermined speed after the driving of the at least one of the fuel injector valves is stopped; and sequentially driving the fuel injector valves of all of the cylinders according to a predetermined fuel injection timing, without stopping driving of said at least one of the fuel injector valves, if it is determined after a predetermined time that the rotating speed of the engine does not reach the predetermined speed.

15. A startup control method according to claim 13, wherein driving of the fuel injector valves is stopped with respect of one of the cylinders upon completion of cylinder identification, and at least alternate ones of the cylinders that follow the one of the cylinders, when it is determined that the engine can be successfully started by driving less than all of the fuel injector valves.

16. A startup control method according to claim 12, further comprising:

detecting a temperature of coolant within the engine; and comparing the temperature of the coolant to a first predetermined temperature, wherein the fuel injector valves of all of the cylinders are sequentially driven according to a predetermined fuel injection timing, without stopping driving of any of the fuel injector valves, when the temperatures of the coolant is lower than the first predetermined temperature.

17. A startup control method according to claim 16, further comprising:

comparing the temperature of the coolant to a second predetermined temperature, wherein the fuel injector valves of all of the cylinders are sequentially driven according to a predetermined fuel injection timing, without stopping driving of any of the fuel injector valves, when the temperature of the coolant is higher than the second predetermined temperature that is higher than the first predetermined temperature.

18. A startup control method according to claim 12, further comprising:

detecting an ambient temperature proximate to the engine; and comparing the temperature to a predetermined ambient temperature, wherein the fuel injector valves of all of the cylinders are sequentially driven according to a predetermined fuel injection timing, without stopping driving of any of the fuel injector valves, when the ambient temperature detected is lower than the predetermined ambient temperature.

* * * * *